US005888117A

United States Patent [19]

Sutton

[11] Patent Number: 5,888,117

[45] Date of Patent: Mar. 30, 1999

[54] TRANSPARENT DISPLAY FOR A NOVELTY ITEM

[75] Inventor: Renee Sutton, Old Westbury, N.Y.

[73] Assignee: Isny, Inc., Old Westbury, N.Y.

[21] Appl. No.: 896,763

[22] Filed: Jul. 18, 1997

[51] Int. Cl.[6] ..... A63H 3/52; A63H 3/02; G09F 19/00

[52] U.S. Cl. ..... 446/267; 40/410; 446/369

[58] Field of Search ..... 446/267, 219, 446/485, 369; 40/409, 410, 419; 273/457, 458; 49/406

[56] References Cited

U.S. PATENT DOCUMENTS

| | | | |
|---|---|---|---|
| D. 281,334 | 11/1985 | Adams . | |
| D. 318,311 | 7/1991 | Chen . | |
| D. 322,469 | 12/1991 | Berger et al. . | |
| D. 328,108 | 7/1992 | Nakazawa . | |
| D. 370,678 | 6/1996 | Yau . | |
| 3,588,099 | 6/1971 | Todd | 273/457 X |
| 4,362,299 | 12/1982 | Suzuki | 273/457 |
| 4,507,099 | 3/1985 | Kinberg | 446/267 X |
| 4,742,500 | 5/1988 | Luce . | |
| 4,929,211 | 5/1990 | Resnick et al. | 446/267 X |
| 5,072,843 | 12/1991 | James . | |
| 5,092,065 | 3/1992 | Teng . | |
| 5,092,807 | 3/1992 | Lew et al. | 446/219 |
| 5,104,699 | 4/1992 | Pantaleo et al. | 273/457 X |
| 5,114,376 | 5/1992 | Copely et al. | 446/485 X |
| 5,165,781 | 11/1992 | Orak | 446/485 X |
| 5,207,728 | 5/1993 | Fogarty et al. | 446/267 X |
| 5,256,457 | 10/1993 | Pantaleo et al. | 273/457 X |
| 5,261,848 | 11/1993 | Kaplan et al. | 446/267 X |
| 5,416,995 | 5/1995 | Teng . | |
| 5,655,321 | 8/1997 | Chang | 40/409 |
| 5,666,750 | 9/1997 | Segan et al. | 446/267 X |

*Primary Examiner*—D Neal Muir
*Attorney, Agent, or Firm*—Blank Rome Comisky & McCauley LLP

[57] ABSTRACT

A decorative display apparatus comprises a transparent, liquid water filled display positionable in an inanimate object. The liquid display includes a one-piece, molded plastic base having inner and outer concentric rings extending from its front surface. A semi-spherical transparent enclosure made of hard or deformable plastic overlies a portion of the front surface, with lower edges of the enclosure being sealingly connected to the front surface between the rings. Decorative objects and water having miniature objects suspended therein fill the cavity defined by the front surface of the base and the inner walls of the enclosure. Holes for receiving connector, such as thread, are provided along the outer flange portion of the base. The liquid display is positioned in an opening provided in the inanimate object, which is preferably a stuffed animal, a beanbag, a pillow, a backpack or a key chain. When assembled, the inner surface of the inanimate object surrounding the opening engages the outer flange portion of the front surface of the base, thereby securing the display to the inanimate object. While additional connector, such as adhesive, thread, and mating swatches of hook-and-loop fastener material, may be provided, no securing assembly integral with or removable from the inanimate object is required.

24 Claims, 3 Drawing Sheets

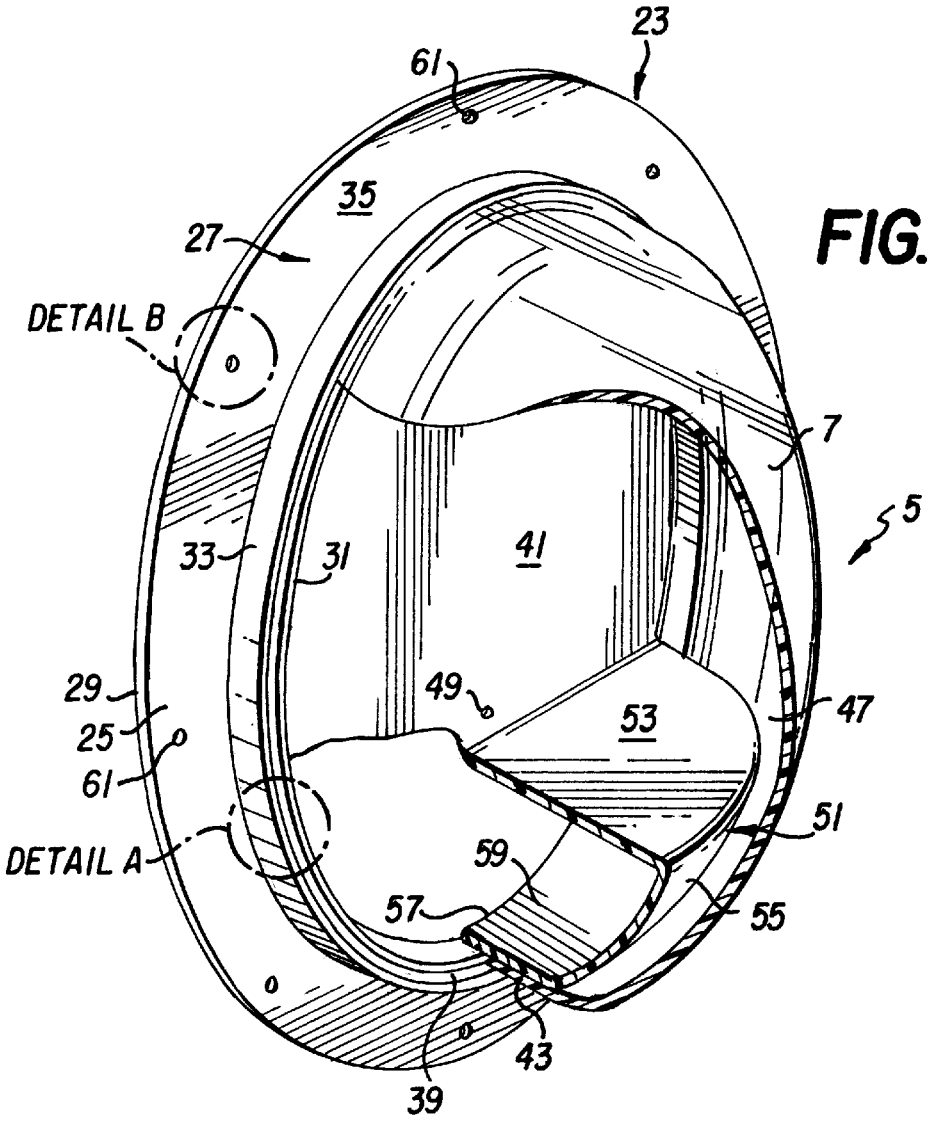
FIG. 3
FIG. 5
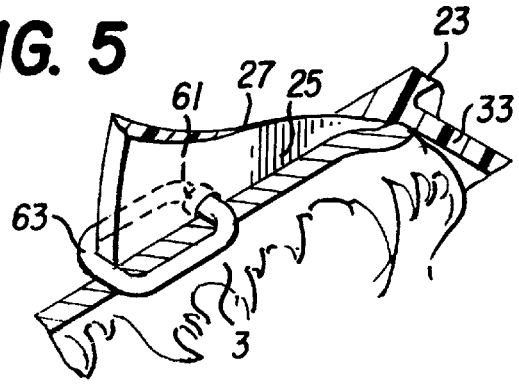
FIG. 4
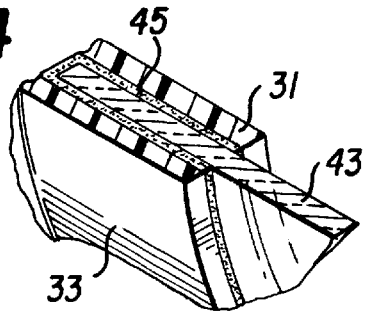

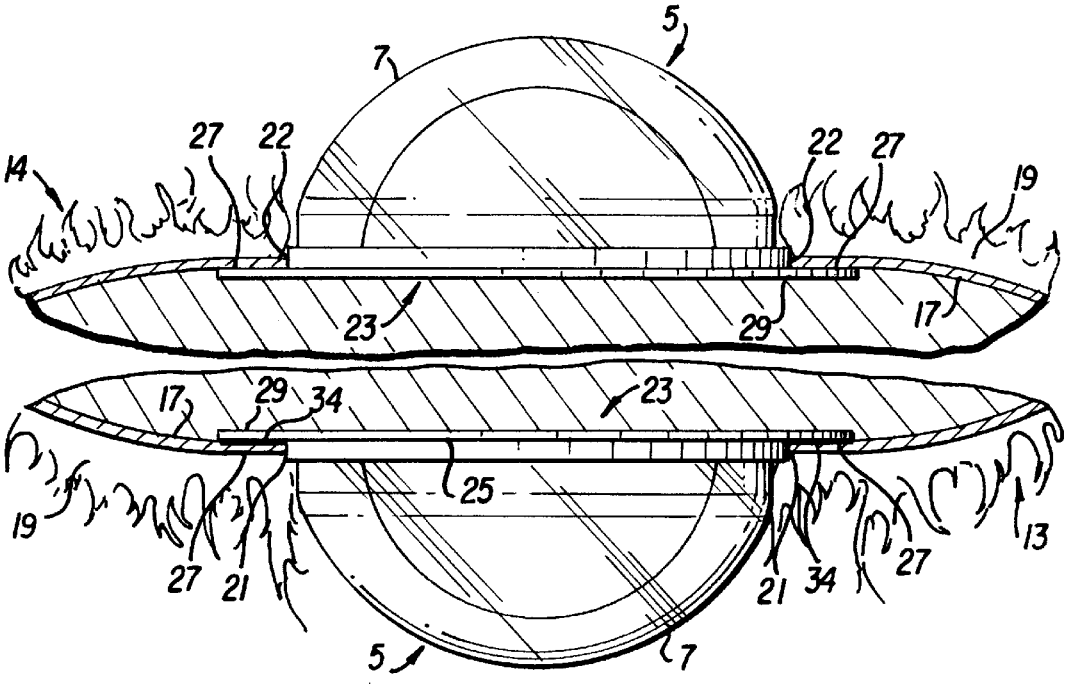
FIG. 6
FIG. 7
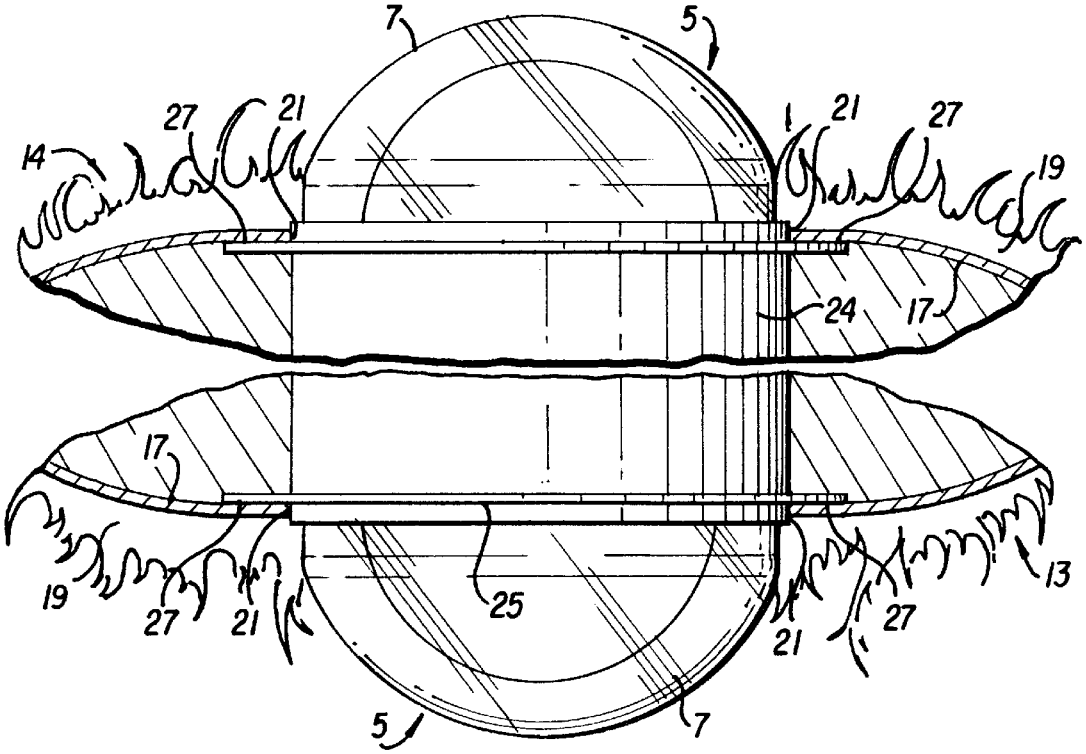

TRANSPARENT DISPLAY FOR A NOVELTY ITEM

FIELD OF THE INVENTION

The present invention relates to novelty items carrying display devices, and more particularly to an inanimate object having a transparent, liquid water filled display provided therein.

BACKGROUND OF THE INVENTION

Children and adults enjoy accessorizing rooms with stuffed animals and other novelty items. Teddy bears and dolls take on personalities of their own, particularly when adorned in seasonal or regional outfits. It is the unique, personalized features of the stuffed animals and dolls that attract those toys to their future owners.

Consumers of novelty items search for and appreciate good values. Quality, appearance and price play important roles in purchasing decisions. Safety is also a major concern, particularly for parents having small children.

For years, seasonal scenes have been uniquely captured in three-dimensional displays known as water balls. A conventional water ball includes a generally spherical globe that is filled with water. Free-floating objects for imitating bubbles or snow are suspended in the water. Decorative means such as plastic figures, lights and movable characters are also provided in the globe. Typical water balls having stationary and fixed decorative articles provided therein are disclosed in U.S. Pat. Nos. 5,092,065 and 5,416,995.

Stuffed animals have been combined with unique articles to create distinctive, appealing items. Generally, those items require a securing assembly be provided as part of the stuffed animal for holding the article in place. According to the apparatus disclosed in U.S. Pat. No. 4,742,450, a decorative time keeping apparatus includes a stuffed animal having a clock removably secured therein. A housing having means for releasably holding the clock is provided as the securing means. The housing is inserted in an opening in the stuffed animal and secured to the surrounding fabric.

According to the apparatus disclosed in U.S. Pat. No. 5,072,843, a baby bottle holder includes a stuffed animal having a generally circular opening extending therethrough which is sized for receiving a bottle. A non-expandable ring-like member is provided in the opening for gripping and holding the bottle.

To manufacture existing stuffed animal/decorative article combinations, conventional stuffed animals must be retrofitted with a securing assembly matched to the locking means or engaging surface of the article to be secured. That requirement results in increased manufacturing and assembly costs, increased incidence of failure and limited interchangeability. For example, in U.S. Pat. No. 5,072,483, it is specifically provided that support members must be included and that bottles of varying shapes and sizes are only compatible with support members equipped with rings of precise diameters. Manufacturers must custom make the stuffed animal, the securing assembly and the display article, which results in lower productivity and increased costs that are passed on to the consumer in the form of higher prices.

It would be desirable to provide a cost-effective, high-quality, attractive inanimate object/water ball combination toy or novelty item that does not require a securing assembly and that is safely enjoyed by parents and children alike.

SUMMARY OF THE INVENTION

The present invention is directed to a decorative display apparatus particularly for holiday and other festive seasons.

The apparatus includes an inanimate object and a three-dimensional liquid water filled display. The inanimate object, which may be a stuffed animal, a pillow or the like, includes a body portion having a central opening. The opening may be provided in any surface of the body portion and may extend completely through the body portion. The display, which includes a base and a transparent enclosure, is positionable in the opening, with the base being directly secured to the inner surface of the body portion surrounding the opening. The body portion of the inanimate object need not be retrofitted with a connector housing, gripping ring or similar structure to effectively retain the display in the opening.

The display is a water ball having a molded base that serves as both the backdrop of the display and the attachment means. The base is a one-piece molded structure having a pair of concentric, oblong rings extending from the front surface. The rings divide the front surface into three distinct regions: a display surface defined by the portion of the front surface enclosed by the innermost ring; a sealing surface provided between the rings; and a securing surface, constituting the outer flange portion of the front surface between outer edges of the base and the outermost ring. The enclosure is transparent or translucent and is made of a hard or soft plastic. Lower edges of the enclosure extend between the rings and rest along the sealing surface. A sealing adhesive or sealing ring is applied or positioned between the rings and along the sealing surface for securing the enclosure to the base and for providing a water and air-tight seal. Water fills the cavity defined by the display surface and the inner surface of the enclosure. Display articles and illumination means are fixedly or movably assembled in the cavity, with miniature objects resembling snow or bubbles being suspended in the water.

The opening in the inanimate object typically has dimensions similar to those of the outermost ring, such that the entire outer flange portion of the base is not visible when the display is positioned in the inanimate object. The inner surface of the inanimate object defining the opening contacts the opposing front surface of the outer flange portion of the base and impedes inadvertent dislodgement of the display from the opening. Additional connectors are provided along the front surface of the flange portion, the inner surface of the inanimate object surrounding the opening, or both, for further securing the display to the inanimate object. In one embodiment, the base is secured to the inanimate object via thread which passes through and the inner surface of the inanimate object and miniature holes extending laterally through the outer flange portion of the base.

Advantageously, the displays and the inanimate objects of the present invention are generally interchangeable. Manufacturing and assembly costs are reasonable, as existing stuffed animals or similar objects need not be retrofitted with complex, specially-designed housing assemblies that only secure a limited selection of displays. Plastic snaps and hooks that generally fail over a short period of time are not included, thereby increasing the effective lifetime of the product.

When the transparent enclosure of the base is made of a deformable plastic, user safety is enhanced and product lifetime is increased. When assembled, the user only comes into contact with the outer surface of the inanimate object and the transparent enclosure. No hard surfaces or rough edges are exposed. In embodiments where the displays are combined with teddy bears and the like, the soft enclosures of the displays maintain the cuddly nature of the inanimate objects.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 3 is a broken perspective view of the liquid water filled display;

FIG. 4 is an enlarged detail A of FIG. 3;

FIG. 5 is an enlarged detail B of FIG. 3 showing the base threadably attached to the inanimate object;

FIG. 6 is a cross-sectional view of another embodiment of the present invention having a first decorative display positioned in a front of the inanimate object and a second inanimate display positioned in a back of the inanimate object; and FIG. 7 is a cross-sectional view of another embodiment of the present invention having a channel extending through the inanimate object and a decorative display positioned in the channel.

DETAILED DESCRIPTION OF THE INVENTION

Figure 1:
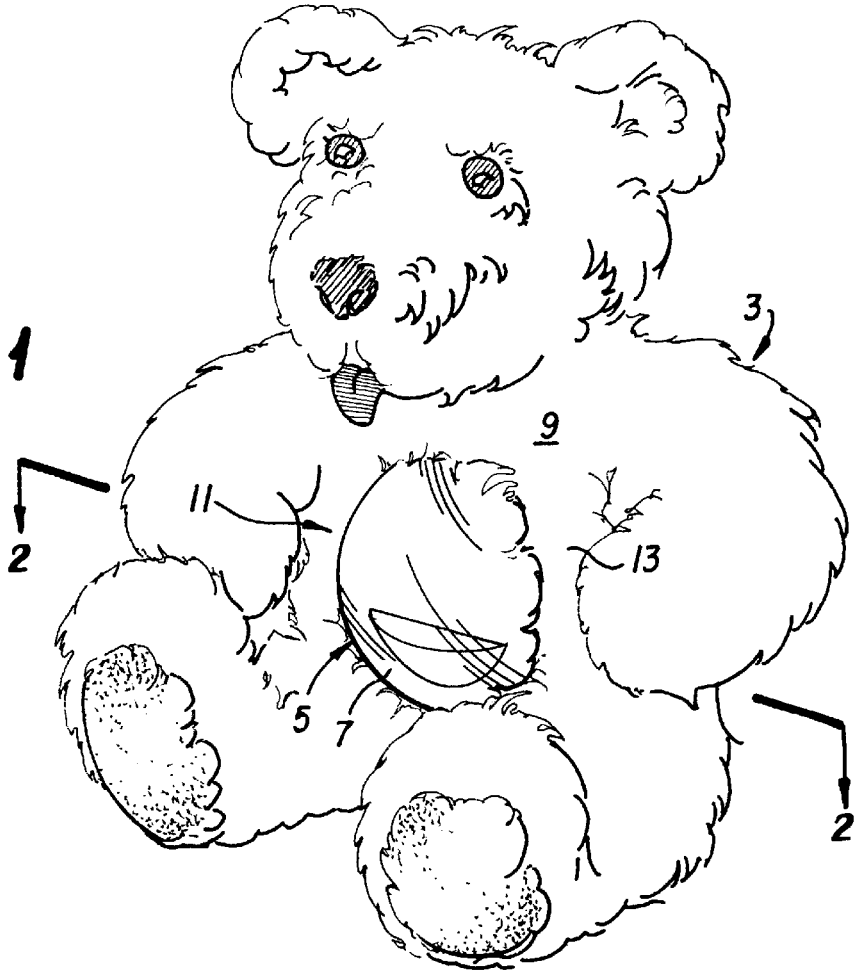
FIG. 1 is a front perspective view of the present invention.

Referring now in detail to the drawings, there is shown in FIG. 1 a decorative display apparatus according to the present invention which is designated by the reference numeral 1. In a preferred form, the apparatus 1 includes an inanimate object 3 and a liquid water filled display 5 having a transparent anterior surface enclosure 7. The display 5 is removably or permanently connected to the inanimate object 3 and is three dimensional, with the transparent enclosure 7 extending beyond the outer surface 9 of the inanimate object 3. In preferred embodiments, the exposed portion of the display, namely the transparent anterior surface enclosure 7, is made of a deformable material, such as soft plastic.

Figure 2:
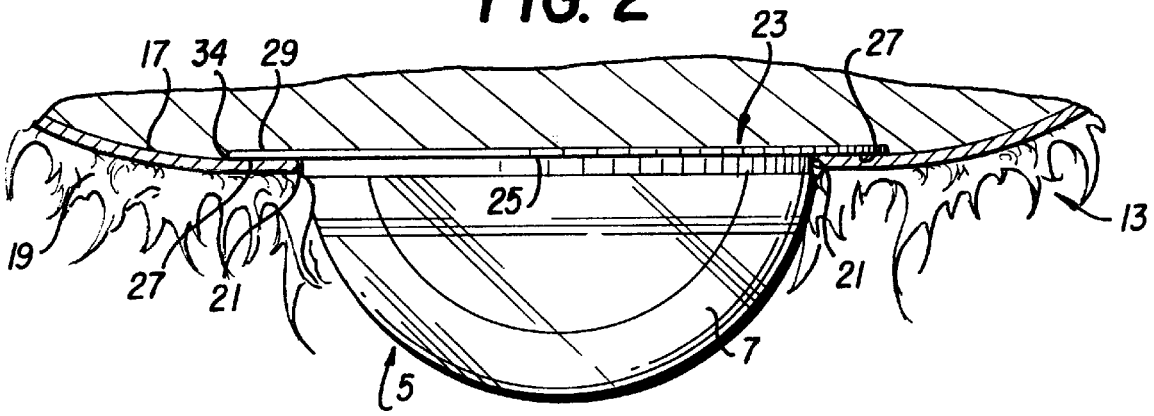
FIG. 2 is a cross-sectional view of the decorative display apparatus taken along line 2—2 of FIG. 1.

The inanimate object 3 has a body portion 11 that includes a front 13, a back 14 (FIG. 6), an inner surface 17 (FIG. 2) and an outer surface 19 (FIG. 2). FIG. 1, and the foregoing and following description, present the inanimate object 3 as a stuffed teddy bear. It is understood, however, that the use of other inanimate objects, such as pillows, key chains, beanbags, backpacks and the like, as well other stuffed animals, is evident to one of ordinary skill in the art and is considered to be under the scope of the present invention. The inanimate object 3 may be made of any appropriate material or fabric and is not limited to a particular constitution or configuration. For example, the inanimate object 3 may be made of textured fabric, leather, plastic or the like. The inanimate object 3 may also be filled with fiber-fill or stuffing, such as foam rubber.

Referring to FIG. 2, the inanimate object 3 has at least one opening 21 provided therein. The transparent, liquid water filled display 5 having a base 23 and a transparent enclosure 7 connected to a front surface 25 of the base 23 is received in the opening 21. The outer flange 27 of the base 23 is trapped in position and held by the inner surface 17 of the inanimate object 3 surrounding the opening 21. The inner surface 17 of the inanimate object 3 surrounding the opening 21 overlies and presses against the front surface 25 of the outer flange 27. Only the transparent enclosure 7 protrudes through the opening 21. Additional fastening means may be provided along the inner surface 17 of the inanimate object 3, the front surface 25 of the base 23, or both.

The body portion 11 of the inanimate object 3 has an opening 21 provided in at least its front 13. The dimensions of the opening 21 are preferably consistent with those of the transparent enclosure 7 of the liquid display 5 such that the transparent enclosure 7 appears to be continuous with the front 13 of the inanimate object 3. When assembled the transparent enclosure 7 houses a display of figures, floating objects and the like, that is visible from the front and sides of the inanimate object 3. A lining may be provided between the display 5 and the opening 21 to keep stuffing material from escaping through the opening 21. A similar opening 22 may be provided in the back of the inanimate object for receiving a second display (FIG. 7). As shown in FIG. 7, a generally cylindrical channel 24 may extend through the inanimate object 3 or for supporting a combination forward facing and a rearward facing display.

Referring now in particular to FIGS. 3–5, the liquid water filled display apparatus 5 for mounting in the inanimate object 3 will be described in greater detail. The display, which is designated by reference numeral 5, includes a base 23 having a front surface 25 and a back surface 29. Inner and outer concentric rings 31, 33 extend from the front surface 25. The rings 31, 33 are upstanding walls that divide the front surface into three distinct sections: an outer flange section 35 constituting the portion of the front surface 25 between outer edges 37 of the base 23 and the outer ring 33, a sealing section 39 constituting the portion of the front surface 25 between the rings 31, 33, and a display section 41 constituting the portion of the front surface enclosed by the inner ring 31. A transparent, three-dimensional, generally semi-spherical enclosure 7 overlies the display section 41 of the front surface 25. Lower ends 43 of the enclosure 7 extend between the inner ring 31 and the outer ring 33 (FIG. 4) and rest along the sealing section 39 of the front surface 25. The lower ends 43 extend straight down from the rounded portion of the enclosure 7 for facilitating positioning and attachment of the enclosure 7 between the rings 31, 33. As shown in FIG. 4, a sealant 45, a sealing ring, or the like is provided where the lower edges 43 of the enclosure 7 meet the sealing section 39 of the front surface 25 of the base 23, the rings 31, 33, or both, to secure the enclosure 7 to the base 23. A water and air-tight cavity 47 is formed by the display section 41 of the front surface 25 of the base 23 and the inner walls of the enclosure 7. Water or other liquid is introduced into the cavity 47 after the enclosure 7 is sealed to the base 23 through a small channel 49 extending through the base 23 from the display section 41 of the front surface 25 to the back surface 29 of the base, 23. A plug is provided for sealing the channel 49.

Miniature objects for imitating snows, stars and the like are suspended in the liquid within the cavity 47. Decorative objects, such as small figurines, are also provided in the cavity 47. The objects may be free floating or may be connected to the base. The mounted objects may have movable parts that are driven by any acceptable driving means. The driving means, which is secured to the base or to the inanimate object, may be a low level motor powered by a power source, such as a dry battery pack. Illuminating means, such as light bulbs or glow-in-the-dark structures, may also be fixed to the base 23 or suspended in the cavity 47.

As shown in FIG. 3, the display section 41 of the base 23 includes a raised platform 51. The platform 51 has a first wall 53 extending at an angle generally perpendicular to the front surface 25 of the base 23 and a second wall 55 sloping downward and outward from edges of the first wall 53. The second wall 55 has lower edges 57 that generally follow the curvature of the inner ring 31. The lower portion 59 of the second wall 55 is generally vertical and preferably rests directly against the inner surface of the inner ring 31 or is continuous with the inner ring 31.

The liquid display 5 is preferably a two-part assembly made of hard plastic, soft plastic, or a combination of the two. The base 23 is a one-piece molded structure. To facilitate the molding process, the raised platform 51 of the display 5 is hollow. It is desirable, especially when small children are the intended users, to fabricate the enclosure 7 of a deformable, soft plastic. It should be understood, however, that the display 5 may be made of any acceptable material.

Attachment means 34, including but not limited to adhesive hook and loop connectors (FIG. 6), i.e., mating Velcro swatches and the like, may be provided between the inner surface 17 of the inanimate object 3 and the outer flange section 35 of the front surface 25 of the base 23 for further securing the base 23 to the inanimate object 3. Referring to FIGS. 3 and 5, in one embodiment small apertures 61 extend transversely through the outer flange 27 of the base 23. Thread 63 or string is pulled through the apertures 61 and sewn to the inanimate object 3 for further securing the base 23 in the opening 21.

Multiple liquid displays may be provided in a single inanimate object. In one embodiment, the inanimate object has a channel extending completely therethrough. A display having a pair of transparent enclosures mounted on opposite surfaces of the base is inserted in the channel. The front surface and the back surface of the base are constructed identically with the front surface of the embodiment shown in FIG. 3. A portion of the section of the base enclosed by the inner ring may be removed to provide communication between the transparent enclosures. The front and back surfaces of the base are connected to the regions of the inanimate object surrounding the front and back openings, respectively, of the channel. When assembled, the transparent enclosures extend through the openings in the inanimate object, thereby providing visual access to the display from all sides of the inanimate object.

Numerous variations of the preferred embodiment are contemplated. For example, the shape of the display apparatus 5 can vary; hemispherical, oval, triangular, or any non-regular shape, e.g., heart shaped. Additionally, the display apparatus 5 can include conventional circuitry for lighting or for sound or for special effects. The housing material can include a fluorescent agent for glowing in the dark.

From the foregoing, it should be readily apparent and appreciated by those skilled in the art that the present invention provides a particularly attractive and safe amusement device for children and adults.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

I claim:

1. A decorative display apparatus comprising:

an inanimate object having a body portion, said body portion having a front, a back, an inner surface and an outer surface;

at least one opening provided in at least said front of said body portion; and a display positioned in said opening of said body portion, said display having a substantially rigid base, a transparent anterior surface connected to said base, wherein said surface is pliant and flexible to a user's touch, a liquid-retaining cavity defined by said base and said surface and which can be viewed from said anterior surface, and a liquid-immersed display means located beneath said anterior surface.

2. Apparatus according to claim 1, wherein said display anterior surface is of a hemispherical shape.

3. Apparatus according to claim 1, wherein said inner surface of said inanimate object surrounding said opening are the only means of said apparatus for securing said display in said opening of said inanimate object.

4. Apparatus according to claim 1, wherein said base has an outer flange, said outer flange having small apertures extending therethrough, and further including thread interconnected between said apertures and said inner surface of said inanimate object around said opening for further securing said display to said inanimate object.

5. Apparatus according to claim 1, wherein said base has a front surface, wherein connecting means is provided between said inner surface of said body portion and said front surface of said base portion of said display, said connecting means selected from the group consisting of adhesive and hook-and-loop connectors.

6. Apparatus according to claim 1, wherein said inanimate object is a stuffed animal.

7. Apparatus according to claim 1, wherein said body portion of said inanimate object is made of fabric, has a cavity provided between said front and said back, and further includes stuffing positioned in said cavity.

8. Apparatus according to claim 7, wherein said inanimate object further includes a lining positioned between said stuffing and said opening for preventing said stuffing from exiting through said opening.

9. Apparatus according to claim 1, wherein said base has a front surface, inner and outer concentric rings extending from said front surface, said rings dividing said front surface into a display surface, a sealing surface and a securing surface, said display surface being that portion of said front surface enclosed by said inner ring, said sealing surface being that portion of said front surface between said rings, and said securing surface being that portion of said front surface between outer edges of the base and the outer ring, said anterior surface having lower edges received between said rings and abutting said sealing surface, and said securing surface engaging said inner surface of said inanimate object.

10. Apparatus according to claim 9, further including sealant provided between said lower edges of said enclosure and said inner ring, said outer ring and said sealing surface, and wherein said liquid-retaining cavity is defined by said display surface, said inner ring and inner surfaces of said front surface.

11. Apparatus according to claim 9, said base of said display having a platform extending from said display surface, said platform having a first wall extending at an angle generally perpendicular to said display surface and a second wall sloping downward and outward from edges of said first wall.

12. Apparatus according to claim 11, said display having decorative objects mounted on said base.

13. Apparatus according to claim 1, wherein said display means further comprises objects placed in said cavity, and wherein said objects glow in the dark.

14. Apparatus according to claim 1, wherein said inanimate object has a second opening in said back, and further including a second a transparent display positionable in said opening of said body portion, said second display having a base portion with a front surface and transparent enclosure connected to said front surface, and wherein said inner surface of said body portion surrounding said second opening engages said front surface of said base for securing said display to said inanimate object.

15. Apparatus according to claim 1, wherein said inanimate object has an opening in said back and a continuous, generally cylindrical channel extending between said opening in said back and said opening in said front, said base if said display having said transparent anterior surface extending from a front surface and a transparent posterior surface extending from a back surface thereof, and wherein said inner surface of said inanimate object surrounding said openings engages outer flange portions of said base for securing said display in said channel.

16. Apparatus according to claim 7, wherein said body portion is a teddy bear.

17. Apparatus according to claim 1, wherein manipulation of said pliable anterior surface enables a user to manipulate said display means.

18. A decorative display apparatus comprising:

an inanimate object having a body portion, said body portion having a front;

an opening provided in said front of said body portion; and a display positioned in said opening of said body portion, said display having a substantially planar, flexible base, a transparent forward wall connected to said base forming a liquid-retaining cavity, wherein said forward wall is pliant and flexible to a user's touch, and wherein said liquid-retaining cavity can be viewed from outside said forward wall, and a liquid-immersed display means located in said liquid-retaining cavity for viewing.

19. The device of claim 18, wherein said base includes an extended portion which is greater than the size of said opening of said body portion for attachment to said body portion.

20. The device of claim 18, wherein said base includes a pair of concentric upstanding rings spaced apart to form a groove for receiving said anterior wall.

21. The device of claim 18, wherein said base includes a continuous flange, and has a surface area which is larger than the surface area of said opening of said body portion.

22. The device of claim 18, wherein said display cavity includes a platform covered with liquid.

23. The device of claim 18, wherein said base includes a groove for fixedly receiving said anterior wall.

24. The device of claim 23, wherein said base and said anterior wall are secured within said groove with a sealant.

* * * * *